United States Patent [19]

Mills et al.

[11] 4,120,378

[45] Oct. 17, 1978

[54] MOVABLE WORK SUPPORT FOR CYLINDRICAL STRUCTURES

[76] Inventors: Ernest E. Mills; E. Bennett Mills; Stanley L. Mills, all of R.R. 1, Straughn, Ind. 47387

[21] Appl. No.: 774,772

[22] Filed: Mar. 7, 1977

[51] Int. Cl.[2] ..... E04G 3/10

[52] U.S. Cl. ..... 182/14; 182/128; 182/142

[58] Field of Search ..... 182/142, 128, 14, 13, 182/12, 229, 143, 144

[56] References Cited

U.S. PATENT DOCUMENTS

| | | | |
|---|---|---|---|
| 1,073,293 | 9/1913 | Sideman | 182/142 |
| 3,464,520 | 9/1969 | Anderson | 182/142 |
| 3,643,761 | 2/1972 | Melton | 182/37 |

FOREIGN PATENT DOCUMENTS

| | | | |
|---|---|---|---|
| 554,438 | 3/1958 | Canada | 182/128 |
| 478,103 | 8/1975 | U.S.S.R. | 182/142 |

*Primary Examiner*—Reinaldo P. Machado
*Attorney, Agent, or Firm*—Woodard, Weikart, Emhardt & Naughton

[57] ABSTRACT

A movable work support particularly adapted for use within a silo or similar cylindrical structure is disclosed herein. The work support comprises a frame supporting a work platform and a winch mechanism. A cable extends from the winch to a point of securement at the top of the cylindrical structure, and extension or retraction of the cable from the winch mechanism will cause the framework to lower or raise, respectively. A first pair of wheels is located at an end of the frame opposite the location of the work platform. The first pair of wheels is positioned to engage the side wall of the structure and to roll along the side wall as the frame is moved vertically. A second pair of wheels is mounted near the first pair of wheels on the frame and is oriented to roll along the side wall as the frame is rotated in a horizontal plane within the structure. The first and second pairs of wheels are located such that the center of gravity of the work support is displaced from the point of attachment of the cable at the top of the structure in a direction away from the pairs of wheels. The frame is thereby urged in the direction of the pairs of wheels to ensure frictional engagement of the wheels with the side wall of the structure.

18 Claims, 8 Drawing Figures

MOVABLE WORK SUPPORT FOR CYLINDRICAL STRUCTURES

BACKGROUND OF THE INVENTION

1. Field of the Invention

The present invention relates to a movable work support, also referred to as a scaffold, which is particularly adapted to use within a cylindrical structure, and which includes means for vertical and rotational movement of the support within the structure.

2. Description of the Prior Art

A large variety of scaffolding structures are known in the prior art for particular applications. Scaffolds provide a work surface upon which a workman or apparatus may be positioned adjacent a structure to permit work to be done on the structure. Typically, scaffolds may be classified as either those which are fixed structures which require disassembly and reassembly in order to move their location, and those which incorporate means for changing the location or orientation of the scaffold.

The closest prior art to the present invention is believed to be shown in U.S. Pat. No. 3,420,332, issued to Textor on Jan. 7, 1969. The Textor patent discloses a work support which is adapted for use within a cylindrical structure and which includes means for vertical and rotational movement of the scaffold. The Textor device includes a rigid suspension unit which is connected to the center of the top of a silo or similar structure. At one end of this rigid suspension unit is located a yoke which supports a pair of rollers positioned to bear against the inner surface of the top of the enclosure. A work platform is suspended from the suspension unit by a pair of chains which attach to opposite ends of the work platform. One of the chains extends from the suspension unit at the end of the suspension unit opposite the location of the yoke and bearing rollers. The other chain extends from the suspension unit at a point intermediate the ends of the suspension unit. The chains are thereby positioned such that the center of gravity of the work platform is located to have the point of attachment of the suspension unit to the top of the structure between the bearing rollers and the center of gravity. The center of gravity therefore applies a force which causes the bearing rollers to bear against the top of the structure within which the scaffold is being employed. The work platform of the Textor device also includes wheels which are positioned to bear against the interior of the side wall of the silo or other structure. These wheels are positioned to move the work platform further from the side wall than would otherwise be the case, and therefore causes frictional engagement of the wheels to the side wall. However, the center of gravity of the platform remains located as previously described with respect to the point of attachment of the suspension unit to the top of the structure. In operation, a workman is positioned on the work platform and is thereby located near the portion of the side wall against which bear the wheels located on the platform. The Textor device is suitable for certain structures. However, the Textor device is not operable if a structure has a top which is not smooth on the inside for the bearing rollers to move over or which has a top which is not sufficiently strong at required locations for the rollers to bear against. Some farm structures, for example, have only a tripod at the top with either a thin sheet metal covering, or no covering at all, and the Textor device could not be used therewith for both of the reasons heretofore enumerated.

A hanging scaffold for use within a cylindrical structure is also disclosed in U.S. Pat. No. 1,090,856, issued to Johnson on Mar. 24, 1914. The Johnson scaffold comprises a circular structure including wheels for centering the scaffold within the cylindrical structure. A similar device is disclosed in U.S. Pat. No. 1,284,699, issued to Johnson on Nov. 12, 1918. In U.S. Pat. Nos. 3,187,838, issued to Stewart et al. on June 8, 1965, and 3,241,634, issued to Prosser on Mar. 22, 1966, there are disclosed scaffolding structures which are positionable about the outside of a cylindrical structure.

SUMMARY OF THE INVENTION

A movable work support, particularly adapted for use within a silo or similar structure having a cylindrical side wall and a top, which comprises a frame having first and second ends, the frame including a work support surface at the first end, attachment means for securing a load including the frame to the top of a cylindrical structure, the attachment means including an elongated member having a first end portion connected at a first location on the top of the structure and a second end portion connected to the frame, the load secured by the elongated member having a center of gravity, vertical movement means for moving the frame vertically with respect to the cylindrical structure, horizontal movement means for moving the frame in a horizontal plane relative the cylindrical structure, and bearing means connected with the frame at the second end of the frame for bearing against the side wall of the cylindrical structure at a second location, and locating means for causing the distance between the center of gravity of the load and the second location to be greater than the perpendicular distance from the second location to a vertical line extending through the first location on the top of the cylindrical structure.

It is an object of the present invention to provide a movable work support particularly adapted for use within a silo or similar structure having a cylindrical side wall.

Another object of the present invention is to provide a movable work support which includes means for vertical and rotational movement while suspended within a cylindrical structure.

A further object of the present invention is to provide a movable work support of the described type which is simple and lightweight in construction, and which is easily disassembled and reassembled.

It is another object of the present invention to provide a movable work support as previously described which may be dismantled sufficiently to be passed through a relatively small door and may be readily reassembled within a structure for use.

It is a further object of the present invention to provide a movable work support which may be suspended from a single point within a cylindrical structure, and yet is stable during use.

Another object of the present invention is to provide a movable work support which may be remotely controlled to be moved throughout the interior surface of a cylindrical structure.

It is another object of the present invention to provide a movable work support which obtains its stability and rotational movement ability by bearing against the side wall of a cylindrical structure, rather than bearing against the top of the structure.

It is a further object of the present invention to provide a movable work support of the described type which is adaptable to be used with cylindrical structures of varying internal diameters.

Further objects and advantages of the present invention will become apparent from the description of the preferred embodiments which follows.

DESCRIPTION OF THE PREFERRED EMBODIMENTS

Figure 1:
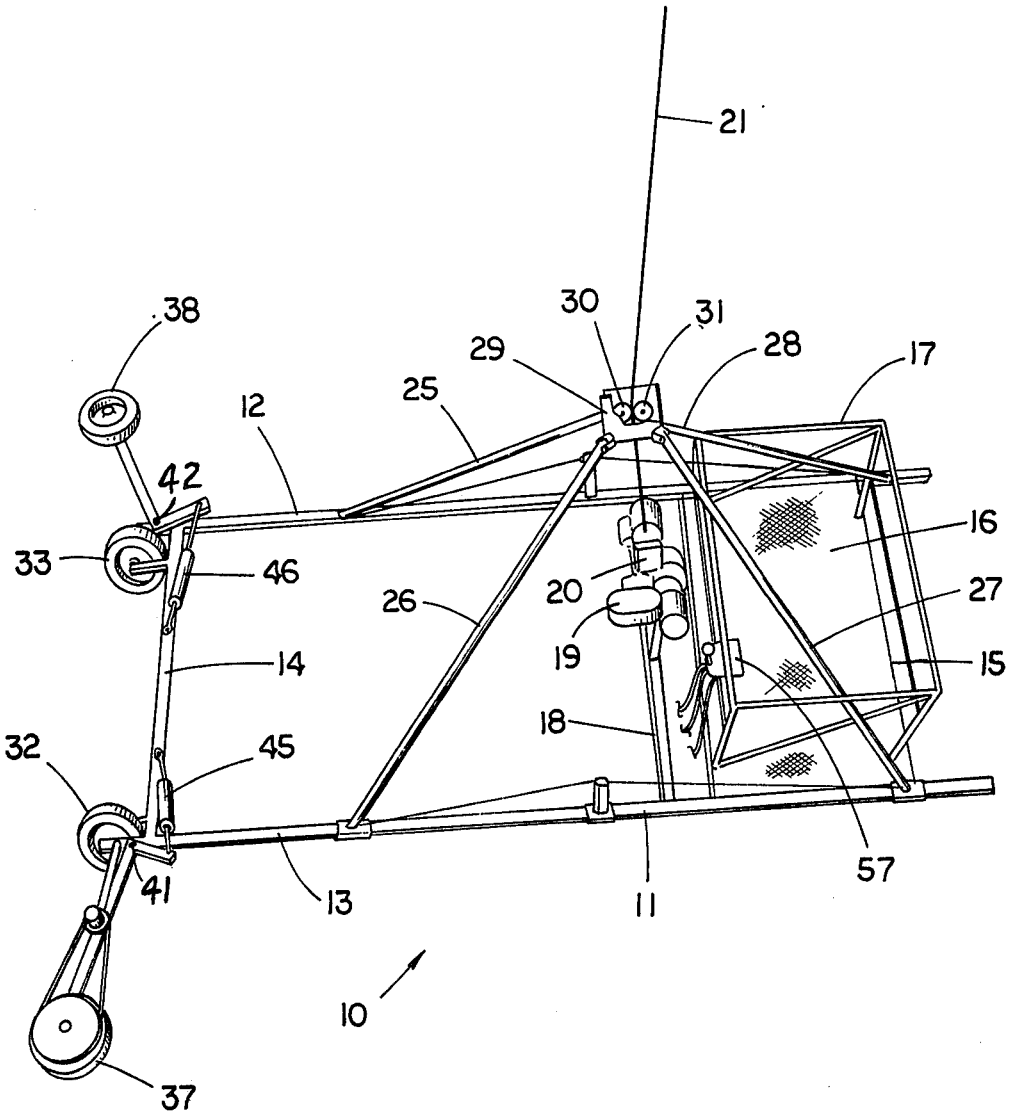
FIG. 1 is a perspective view of a preferred embodiment of the movable work support of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The movable work support of the present invention is particularly adapted for use within a silo or similar structure having a cylindrical side wall and a top. The movable work support of the present invention is a relatively simple and inexpensive device which permits both vertical and horizontal movement of the support to be readily obtained by simple manipulation of appropriate controls. The support has horizontal stability, and is readily adapted for use in conjunction with a variety of existing cylindrical structures. In particular, the scaffold is of such simple construction that it may be readily disassembled and passed through a comparatively-small opening in a structure, and thereafter reassembled for use.

Referring in particular to the figures, there is shown a movable work support 10 constructed in accordance with the present invention. Support 10 includes a frame 11 comprising side rails 12 and 13 and end rails 14 and 15. A work platform 16, including a surrounding fencework 17, is connected to and supported at one end of the frame 11. Work platform 16 is intended to support a person who would operate the movable work support 10, and who could also perform work on the interior walls of the silo or other structure within which the support 10 is being employed. Alternatively, a piece of work apparatus could be mounted in the general location of platform 16 and the movable work support 10 could be remotely controlled to cause the apparatus to operate appropriately.

Frame 11 includes a cross beam 18 upon which motor 19 is mounted. Winch assembly 20 is also mounted upon cross beam 18 and is driven by motor 19. A cable 21 is secured at the top 22 of silo 23 or another similar structure at a location 24. Cable 21 extends from location 24 to winch assembly 20, winch assembly 20 being operable to extend or retract cable 21 to move frame 11 down or up relative the location 24, and therefore relative silo 23. Winch assemblies of the type employed by the movable work support 10 are known in the art, and will therefore not be described in detail in the present text. A variety of winch assemblies could be incorporated in the movable work support 10, and cable 21 could correspondingly be changed to suit the particular winch assembly being used. For example, a winch assembly which operates with a chain could be employed, if a chain were used to suspend frame 11, rather than the cable 21.

A quadripod is formed by support members 25–28. Each of the support members 25–28 is secured at one end to the frame 11, and at the other end to housing 29. Pulleys 30 and 31 are mounted within housing 29 and cable 21 extends therebetween. Pulleys 30 and 31 facilitate vertical movement of the movable work support 10 by rolling against the cable 21 as it is drawn into or extended from winch assembly 20. Pulleys 30 and 31 also provide an elevated bearing point, and increases the distance between the center of gravity of the support 10 and the point along cable 21 at which a tilting force is applied. As a result, the effect of any unbalance of the frame 11 and any supported elements is reduced, and the movable work support 10 has excellent horizontal stability.

Figure 2:
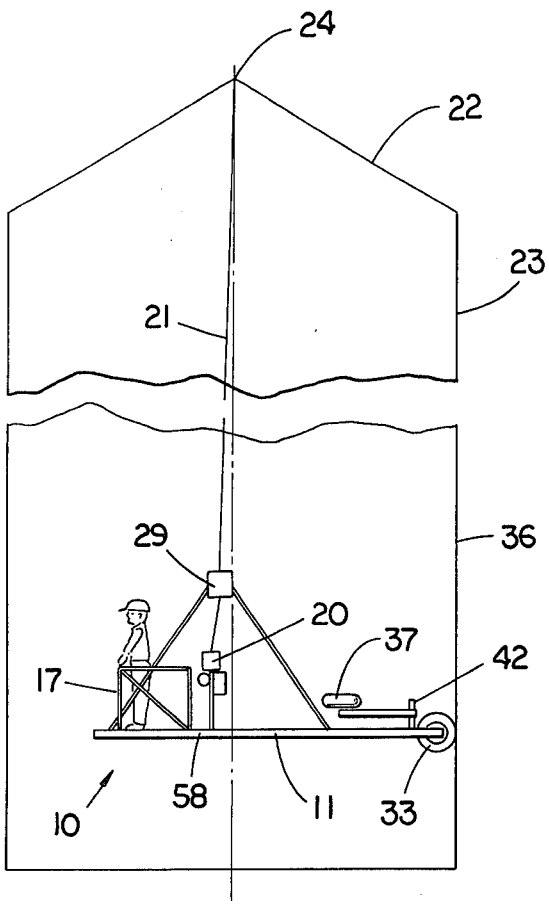
FIG. 2 is a side, diagrammatic view of the movable work support of FIG. 1, showing the vertical-movement wheels engaging the wall of a cylindrical structure.
Figure 5:
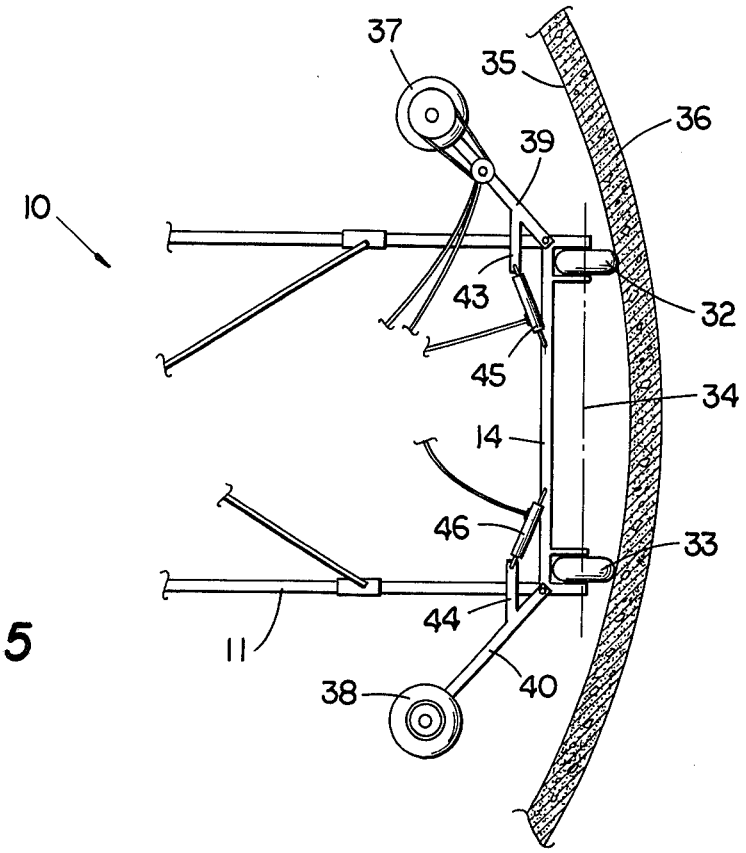
FIG. 5 is a top, partial view of the movable work support of FIG. 1, showing the configuration of the wheel assemblies in correspondence with the position shown in FIG. 2.

Mounted to frame 11 adjacent end rail 14 are two pairs of wheel assemblies. Wheels 32 and 33 are mounted to frame 11 to rotate about a common horizontal axis 34. Referring in particular to FIGS. 2 and 5, it is shown that wheels 32 and 33 are positioned to engage the interior 35 of side wall 36. Because wheels 32 and 33 are rotatable about a horizontal axis, the wheels 32 and 33 will roll along the interior 35 of side wall 36 as frame 11 is raised and lowered relative the wall 36.

Figure 4:
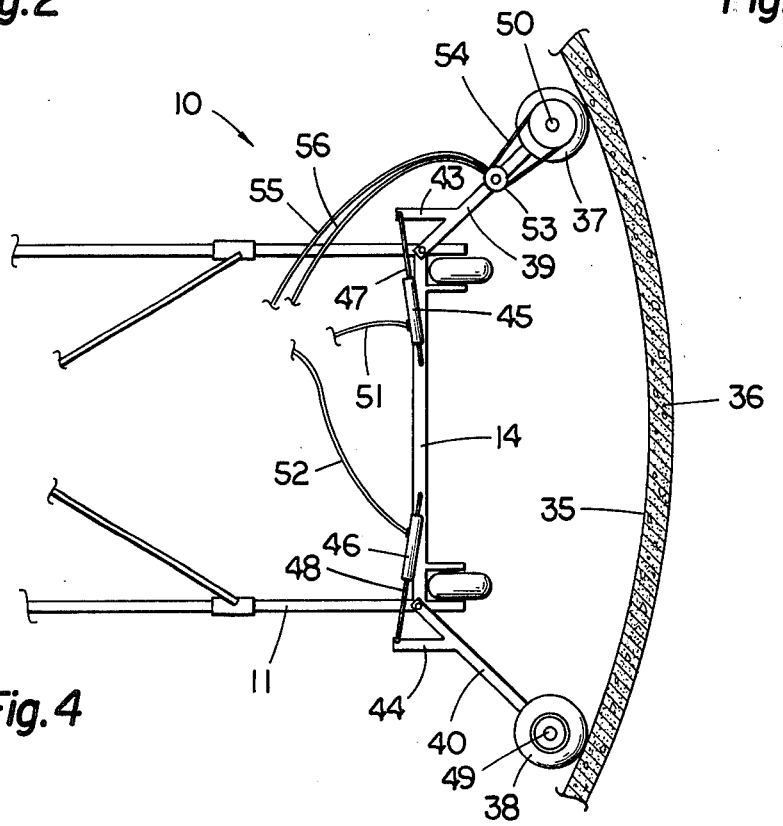
FIG. 4 is a top, partial view of the movable work support of FIG. 1, showing the configuration of the wheel assemblies in correspondence with the position shown in FIG. 3.

Wheels 37 and 38 are mounted upon arms 39 and 40 which are rotatably attached to frame 11 by pivot pins 41 and 42, respectively. Arms 39 and 40 include extensions 43 and 44. Hydraulic cylinders 45 and 46 include piston rods 47 and 48 which are attached, respectively, to extensions 43 and 44. Cylinders 45 and 46 are connected to end rail 14 and are operable to extend or retract piston rods 47 and 48. Referring in particular to FIGS. 4 and 5, it is shown that wheels 37 and 38 have a first position adjacent the interior 35 of wall 36 when piston rods 47 and 48 are extended from hydraulic cylinders 45 and 46, respectively. Wheels 37 and 38 are rotatable about vertical axles 49 and 50, and are thereby operable to roll along interior 35 in correspondence to horizontal, rotational movement of frame 11 within structure 23. Withdrawal of piston rods 47 and 48 within hydraulic cylinders 45 and 46, respectively, rotates arms 39 and 40 about pins 41 and 42, respectively, and thereby retracts wheels 37 and 38 from the interior 35 of side wall 36.

Hydraulic cylinders 45 and 46 include hydraulic hoses 51 and 52 which extend to and connect with a suitable source of hydraulic pressure. A hydraulic-type drive motor 53 is mounted upon arm 39 and a belt 54 drivably connects motor 53 with wheel 38. Hydraulic hoses 55 and 56 connect with motor 53 and extend to and connect with a suitable source of hydraulic pressure. Movable work support 10 includes a control box 57 (FIG. 1) including suitable controls for regulating the hydraulic pressure within hoses 51, 52, 55 and 56, and thereby provide control of the extension and retraction of wheels 37 and 38, and also of the driving of wheel 38. As previously mentioned, control box 57 may be located remote from frame 11 to permit remote control of the movement of the movable work support 10.

Figure 3:
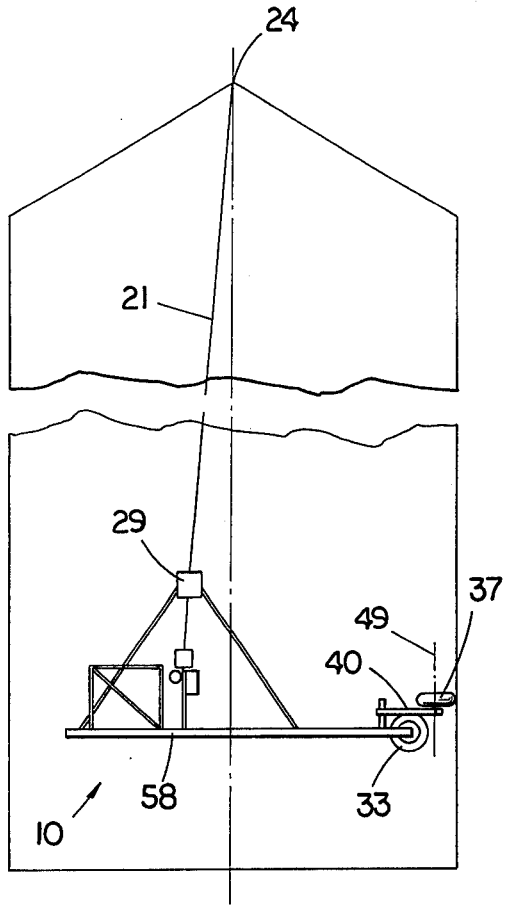
FIG. 3 is a side, diagrammatic view of the movable work support of FIG. 1, showing the horizontal-movement wheels engaging the side wall of a cylindrical structure.

At all times during use of the movable work support 10 of the present invention, either wheels 37 and 38, or wheels 32 and 33 bear against the interior 35 of wall 36. This is ensured by the fact that the distance from the bearing point of the wheels to the center of gravity 58 of support 10 is greater than the distance from the bearing point of the wheels to a vertical line extending through location 24 (FIG. 2). The positioning of the center of gravity 58 is accomplished as a result of several factors. Primarily, frame 11 is constructed such that the center of gravity will be so positioned when wheels 32 and 33 rest adjacent interior 35 of wall 36, and the center of gravity 58 will then be even further displaced upon engagement of wheels 37 and 38 with wall 36 (FIG. 3). If the support 10 is intended for use with a person standing upon work platform 16, then this will further shift the center of gravity of the suspended support 10 and person further from the bearing point of the wheels.

Support 10 could alternatively be constructed such that the center of gravity of the support 10 without a person located on platform 16 would not be displaced from the center of the silo 23 in a direction away from the bearing point of wheels 32 and 33. Support 10 could then still be operable since the positioning of a person on platform 16 could sufficiently shift the center of gravity to fulfill this requirement. It is preferable, however, to construct the frame and position the wheels such that the center of gravity of the support 10 alone is displaced from the center of the cylindrical structure in a direction away from the bearing point of the wheels. The effective force against the side wall 36 is then enhanced by a person being positioned on platform 16. The center of gravity would have to be appropriately positioned when a work apparatus is mounted on support 10 if the support and apparatus are to be operated by remote control.

The purpose in displacing the center of gravity away from the bearing point of the wheels and beyond the center of the structure is that the normal state of a suspended structure, such as support 10, is to have the center of gravity of the suspended load located directly beneath the single point of attachment 24 of the supporting cable 21. Displacement of the center of gravity 58 in the manner previously described will therefore cause the frame 11 to be urged toward the bearing point of wheels 32 and 33 or of wheels 37 and 38 against side wall 36. This force of the wheels against side wall 36 causes frictional engagement between the wheels and the side wall, and provides added horizontal stability to the support 10. In particular, the support will have greater stability when being raised or lowered with the wheels 32 and 33 resting adjacent side wall 36. Moreover, the frictional engagement is increased when wheels 37 and 38 further displace the center of gravity away from side wall 36, and this frictional engagement permits rotation of wheel 37 to move frame 11 in rotation about the interior of cylindrical structure 23.

Figure 6:
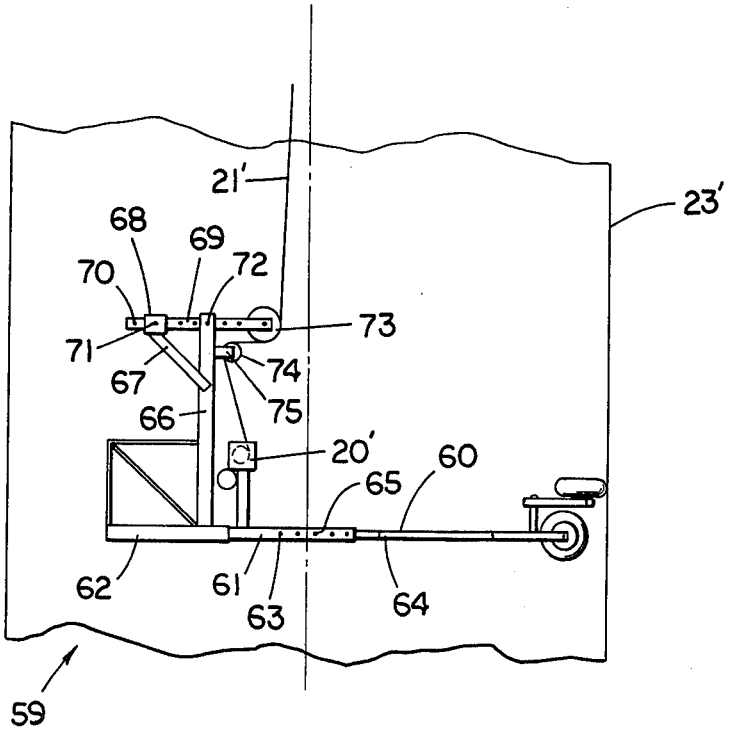
FIG. 6 is a side view of an alternate embodiment of the movable work support of the present invention.
Figure 7:
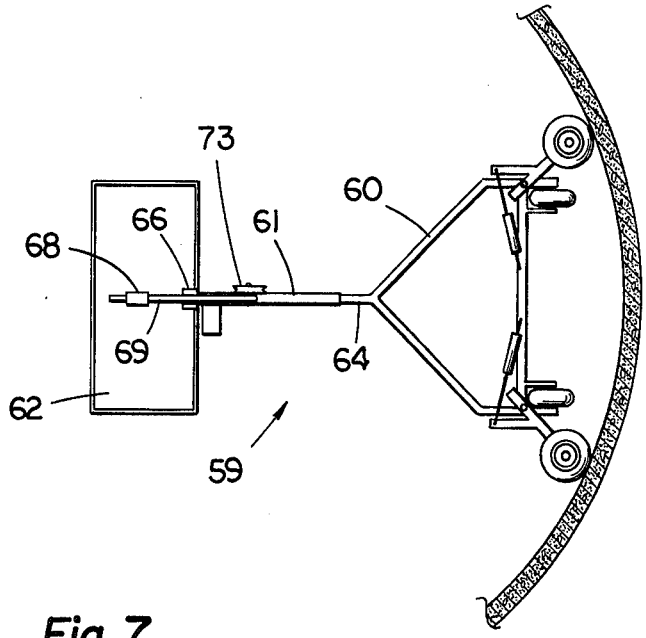
FIG. 7 is a top view of the alternate embodiment shown in FIG. 6.

In FIGS. 6 and 7 there is shown an alternate embodiment of the movable work support of the present invention. Support 59 includes a frame 60 including two pairs of wheel assemblies mounted to one end. The wheel assemblies are identical to those described above with respect to wheels 32, 33, 37 and 38, and therefore will not be described with respect to this alternate embodiment of the invention. A tubular member 61 is mounted to a work platform 62 and telescopingly receives frame 60 therein. Tube 61 includes several pairs of horizontally and diametrically aligned apertures, such as 63. Frame 60 includes tube portion 64 which is received within tube 61, tube portion 64 including at least one pair of horizontally and diametrically aligned apertures. A rod 65 extends between a selected pair of apertures in tube 61 and also through the pair of apertures in tube portion 64, thereby securing tube portion 64 with tube 61. Any of a number of apertures defined by tube 61 may be aligned with and secured to the apertures in tube portion 64 to vary the overall length of movable work support 59. In this manner, support 59 is readily adaptable to use with a variety of silos or other cylindrical structures having different internal diameters. This or another system could be incorporated in the construction of support 10 to similarly provide for adjustability of the support length.

A vertical support 66 is mounted to work platform 62. Angle brace 67 is secured to vertical support 66 and cylindrical sleeve 68 is secured to the end of angle brace 67. Adjustment rod 69 is received within cylindrical sleeve 68, and also within a suitable aperture defined by the top end of vertical support 66. Adjustment rod 69 includes several diametrically aligned pairs of apertures, such as 70. Pins 71 and 72 extend through aligned apertures defined by cylindrical sleeve 68 and vertical support 66, respectively, and also extend within pairs of aligned apertures in adjustment rod 69 to secure the position of rod 69.

Pulley 73 is rotatably mounted to the end of adjustment rod 69, and pulley 74 is similarly mounted within yoke 75 which is secured to vertical support 66. Cable 21' is secured at the top of structure 23' and extends about pulleys 73 and 74 to winch assembly 20'. Winch assembly 20' operates in the same manner as previously described with respect to winch assembly 20 to extend or retract cable 21'. Pulley 74 is fixed relative winch assembly 20', and therefore maintains proper alignment of cable 21' with winch assembly 20'. Pulley 73, however, is movable with respect to winch assembly 20'. This permits the position of pulley 73 relative the point of attachment of cable 21' at the top of structure 23' to be maintained when the relative position of tube portion 64 and tube 61 is varied. Thus, as the overall length of the movable work support 59 is increased, the pulley 73 may be positioned further from vertical support 66 by appropriate movement of adjustment rod 69.

Figure 8:
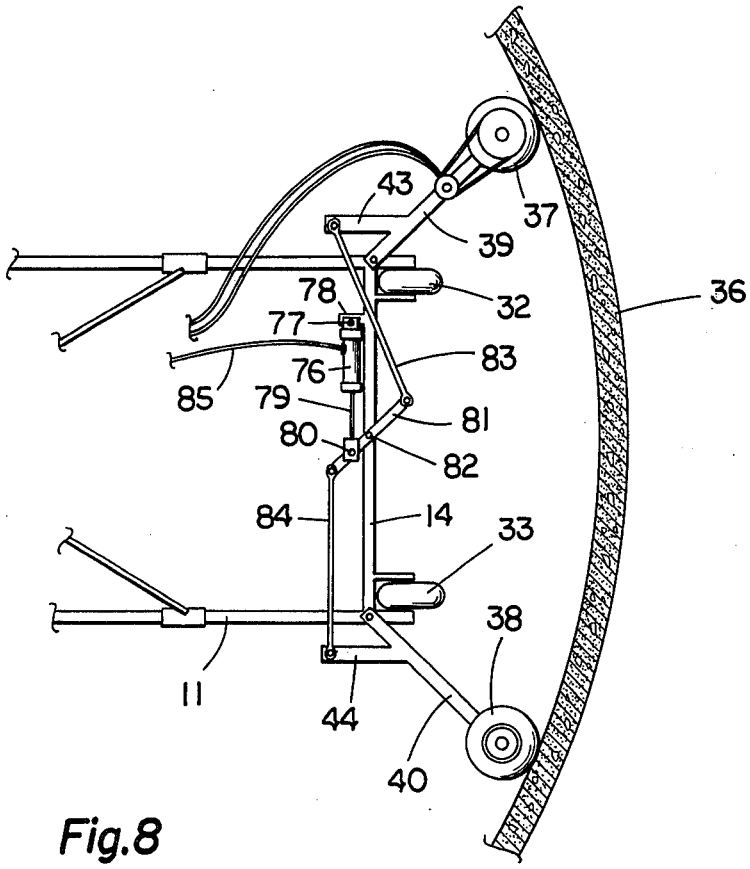
FIG. 8 is a partial, top view of the movable work support of FIG. 1, showing an alternate embodiment for the wheel assemblies thereof.

Referring now to FIG. 8, there is shown an alternate embodiment of the wheel assemblies utilized in accordance with the present invention. Wheels 32 and 33 remain mounted upon frame 11 in the manner previously described with respect to the support 10 of FIG. 1. Wheels 37 and 38 are also similarly mounted upon arms 39 and 40 as previously described. Arms 39 and 40 include extensions 43 and 44. A hydraulic cylinder 76 is mounted to end rail 14 through a bracket 77 connected to flange 78. Hydraulic cylinder 76 includes a piston rod 79 which is extendable from and retractable into cylinder 76. Piston rod 79 is pivotally attached through pivot pin 80 to bar 81, bar 81 being pivotally attached to end rail 14 by pivot pin 82. Rods 83 and 84 each have one end attached to an end of bar 81, and the other end attached to extensions 43 and 44, respectively. As shown in FIG. 8, piston rod 79 has a first position extended from hydraulic cylinder 76 and corresponding to bar 81 being rotated about pivot pin 82 to extend wheels 37 and 38 against wall 36. Retraction of piston rod 79 within hydraulic cylinder 76 pulls rods 83 and 84 inwardly and pivots arms 39 and 40 to retract wheels 37 and 38 from wall 36. Hydraulic hose 85 extends to and is connected with hydraulic cylinder 76 and also a suitable source of hydraulic pressure to provide the described operation of hydraulic cylinder 76.

In a particular embodiment of the present invention, the movable work support has been employed to provide access to the interior walls of grain elevators and farm silos. A typical silo has an internal diameter of about twenty feet and a typical elevator has an internal diameter of between about thirty and forty feet. The movable work support of the present invention has been easily constructed with an appropriately-sized frame 11 to operate within structures of these sizes. In addition, the access door at the bottom of these types of structures is typically relatively small, in the order of twenty inches square. The movable work support 10, as shown in FIG. 1, is readily dismantled to pieces which will fit through a door which is twenty inches square, and can be quickly and surely reassembled within the structure for use.

In one application of the support 10 of the present invention, the support has been used during cleaning and resurfacing the interior walls of silos. The inside concrete in silos is worn away by the action of the acid associated with the silage stored in the silos. An operator positioned on the movable work support 10 of the present invention may readily manipulate the support to provide access to the full interior of the silo. A washing apparatus using 2,000 pounds of water pressure to scour the interior of the silos has been used to clean the silo walls initially. The support 10 provides excellent stability during use of the high pressure scouring apparatus. The vertical and horizontal position of the support is readily controlled by appropriate regulation of the hydraulic systems connected with the wheels and the winch assembly.

The winch assembly used in one embodiment of the present invention was one marketed under the trademark "Sky Climber," and the winch easily moved the support up and down under full control. A "Char Lynn" orbit motor has been used for driving the wheel 37 with good success. It has been found to be preferable to periodically alter the direction in which the frame 11 is rotated relative the structure 23 to prevent undue twisting or tangling of the various control lines, and also any safety lines which may be employed for the operator of the support.

The movable work support 10 of the present invention is a very simple yet sturdy device. In part because of the simplicity of construction, the support 10 may be used with cables already existing in many silos and similar structures which are otherwise used for different purposes. Certain structures include cables which normally extend from the center of the top and are operable through a crank or winch to be lowered and raised. For these structures, the support 10 is easily used by lowering the cable present in the structure and attaching cable 21 thereto. The existing cable is then raised to the top by the means already existing with the structure, and the winch cable 21 is thereby positioned for use. The movable work support of the present invention is relatively light due to the simplicity of construction, and is therefore easily transported. At the same time, the support is sturdy and is well balanced by having a low center of gravity relative the point on cable 21 at which any tilting forces are applied.

The movable work support 10 of FIG. 1 includes a quadripod comprising support members 25–28, connected to housing 29. The points of attachment of members 25–28 to the side rails 12 and 13 of frame 11 may be made adjustable, such as by providing a plurality of holes in the side rails and corresponding holes in the support members. The quadripod, and therefore the position of housing 29, can thereby be adjusted with respect to the length of frame 11 to compensate for varying amounts of weight to be supported upon work platform 16. Other modifications of the disclosed device could similarly be made to adapt the support to various applications. For example, the two pairs of wheels employed for vertical and rotational movement of the support 10 could be replaced by a single pair of wheels operable to swivel to change orientation from vertical to horizontal planes of rotation. The disclosed embodiments of the present invention are preferred, however, since they provide a support which is inexpensively constructed, and which performs excellently.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A movable work support, particularly adapted for use within a silo or similar structure having a cylindrical side wall and a top, which comprises:

a frame having first and second ends, said frame including a work support surface at the first end;

attachment means for securing a load including said frame to about the center of the top of a cylindrical structure, said attachment means including an elongated member having a first end portion connectable at a first location at about the center of the top of the structure and a second end portion connected to said frame, the load secured by the elongated member having a center of gravity;

vertical movement means for moving said frame vertically with respect to the cylindrical structure;

horizontal movement means for moving said frame in a horizontal plane relative the cylindrical structure;

bearing means connected with said frame at the second end of said frame for bearing against the side wall of the cylindrical structure at a second location, the distance between the work support surface of said frame and the second location being greater than half the interior diameter of the cylindrical structure to position the work support surface adjacent a part of the side wall opposite the second location; and locating means for causing the distance between the center of gravity of the load and the second location to be greater than the perpendicular distance from the second location to a vertical line extending through the first location at about the center of the top of the cylindrical structure.

2. The apparatus of claim 1 in which said vertical movement means comprises a winch mounted to said frame, the elongated member of said attachment means being received by the winch, the winch being operable to extend and retract the elongated member relative said frame, whereby said frame is caused to move vertically with respect to the structure.

3. The apparatus of claim 1 in which said vertical movement means includes a first pair of wheels mounted to said frame and rotatable about horizontal axes, the pair of wheels of said vertical movement means being positionable against the interior of the side wall of the structure.

4. The apparatus of claim 1 in which said horizontal movement means includes a second pair of wheels mounted to said frame and rotatable about vertical axes, the pair of wheels of said horizontal movement means being positionable against the interior of the side wall of the structure.

5. The apparatus of claim 4 in which said horizontal movement means comprises a motor mounted to said frame and drivingly connected to at least one of said second pair of wheels, the motor being operable to drive the connected wheels in rotation, whereby said frame is caused to rotate in a horizontal plane within the structure.

6. The apparatus of claim 3 in which said horizontal movement means includes a second pair of wheels mounted to said frame and rotatable about vertical axes, the pair of wheels of said horizontal movement means being positionable against the interior of the side wall of the structure.

7. The apparatus of claim 6 in which said vertical movement means comprises a winch mounted to said frame, the elongated member of said attachment means being received by the winch, the winch being operable to extend and retract the elongated member relative said frame, whereby said frame is caused to move vertically with respect to the structure.

8. The apparatus of claim 7 in which said horizontal movement means comprises a motor mounted to said frame and drivingly connected to at least one of said second pair of wheels, the motor being operable to drive the connected wheels in rotation, whereby said frame is caused to rotate in a horizontal plane within the structure.

9. The apparatus of claim 1 in which one pair of said first and second pairs of wheels is movably mounted to said frame.

10. The apparatus of claim 1 and which further includes means for moving at least one pair of said first and second pairs of wheels toward and away from said frame, said first and second pairs of wheels having a first position in which only said first pair of wheels is positioned against the interior of the side wall of the structure, and a second position in which only said second pair of wheels is positioned against the interior of the side wall of the structure.

11. The apparatus of claim 8 and which further includes means for moving at least one pair of said first and second pairs of wheels toward and away from said frame, said first and second pairs of wheels having a first position in which only said first pair of wheels is positioned against the interior of the side wall of the structure, and a second position in which only said second pair of wheels is positioned against the interior of the side wall of the structure.

12. The apparatus of claim 6 in which said means for moving at least one pair of said first and second pairs of wheels comprises a pair of rods, the rods being pivotally connected to said frame, each of the first pair of wheels being rotatably mounted to one of said pair of rods.

13. A movable work support, particularly adapted for use within a silo or similar structure having a cylindrical side wall and a top, which comprises:

a frame having first and second ends; said frame including a work support surface at the first end;

attachment means for securing said frame to about the center of the top of a cylindrical structure, said attachment means including an elongated member having a first end portion connected at a first location at about the center of the top of the structure and a second end portion connected to said frame;

a first pair of wheels connected to the second end of said frame, said first pair of wheels rotatable about vertical axes and positionable against the interior of the side wall of the structure;

a second pair of wheels connected to the second end of said frame, each of said second pair of wheels being rotatable about a horizontal axis and positionable against the interior of the side wall of the structure, at least one pair of said first and second pairs of wheels being positioned at a location against the interior of the side wall of the structure, the distance between the work support surface of said frame and the location being greater than half the interior diameter of the cylindrical structure to position the work support surface adjacent a part of the side wall opposite the location;

vertical movement means for moving said frame vertically with respect to the structure when said second pair of wheels are positioned against the interior of the side wall of the structure; and horizontal movement means for moving said frame in a horizontal plane relative the structure when said first pair of wheels are positioned against the interior of the side wall of the structure.

14. The apparatus of claim 13 and which further includes bearing means for causing at least one pair of said first and second pairs of wheels to be positioned against the interior of the side wall of the structure, said bearing means including the said frame being sized and said first and second pairs of wheels being positioned to cause the center of gravity of the supported apparatus to urge at least one pair of said first and second pairs of wheels against the interior of the side wall of the structure.

15. The combination of a movable work support and a structure which comprises:

a structure having a cylindrical side wall and a top;

a frame having a first and second ends, said frame including a work support surface at the first end;

attachment means for securing said frame to about the center of the top of said cylindrical structure, said attachment means including an elongated member having a first end portion connected at a first location at about the center of the top of said structure and a second end portion connected to said frame;

a first pair of wheels connected to the second end of said frame, said first pair of wheels rotatable about vertical axes and positionable against the interior of the side wall of the structure;

a second pair of wheels connected to the second end of said frame, each of said second pair of wheels being rotatable about a horizontal axis and positionable against the interior of the side wall of the structure, at least one pair of said first and second pairs of wheels being positioned at a location against the interior of the side wall of the structure, the distance between the work support surface of said frame and the location being greater than half the interior diameter of the cylindrical structure to position the work support surface adjacent a part of the side wall opposite the location;

vertical movement means for moving said frame vertically with respect to the structure when said second pair of wheels are positioned against the interior of the side wall of the structure; and horizontal movement means for moving said frame in a horizontal plane relative the structure when said first pair of wheels are positioned against the interior of the side wall of the structure.

16. The apparatus of claim 15 in which said vertical movement means comprises a winch mounted to said frame, the elongated member of said attachment means being received by the winch, the winch being operable to extend and retract the elongated member relative said frame, whereby said frame is caused to move vertically with respect to the structure.

17. The apparatus of claim 16 in which said horizontal movement means comprises a motor mounted to said frame and drivingly connected to at least one of said second pair of wheels, the motor being operable to drive the connected wheels in rotation, whereby said frame is caused to rotate in a horizontal plane within the structure.

18. The apparatus of claim 17 and which further includes means for moving at least one pair of said first and second pairs of wheels toward and away from said frame, said first and second pairs of wheels having a first position in which only said first pair of wheels is positioned against the interior of the side wall of the structure, and a second position in which only said second pair of wheels is positioned against the interior of the side wall of the structure.

* * * * *